US010156408B1

(12) United States Patent
Buckner

(10) Patent No.: US 10,156,408 B1
(45) Date of Patent: Dec. 18, 2018

(54) FIREARM MAGAZINE LOADING APPARATUS

(71) Applicant: Patrick T. Buckner, San Tan Valley, AZ (US)

(72) Inventor: Patrick T. Buckner, San Tan Valley, AZ (US)

( * ) Notice: Subject to any disclaimer, the term of this patent is extended or adjusted under 35 U.S.C. 154(b) by 0 days.

(21) Appl. No.: 15/598,410

(22) Filed: May 18, 2017

(51) Int. Cl.
*F41A 9/83* (2006.01)

(52) U.S. Cl.
CPC ..... *F41A 9/83* (2013.01)

(58) Field of Classification Search
CPC ..... F41A 9/67; F41A 9/83; F41A 9/02; F41A 9/84; F41A 9/86; F41A 9/82; F41A 9/85
USPC ..... 42/87, 88
See application file for complete search history.

(56) References Cited

U.S. PATENT DOCUMENTS 2,338,984 A 1/1944 VanHorn et al.
4,879,829 A 11/1989 Miller et al.
4,926,742 A 5/1990 Ma et al.
4,970,820 A 11/1990 Miller et al.
5,301,449 A 4/1994 Jackson
9,182,185 B2 * 11/2015 Hatch ..... F41A 9/83
9,404,697 B2 8/2016 Cobb
9,612,070 B2 * 4/2017 Hatch ..... F41A 9/67
2016/0102932 A1 4/2016 Cobb
2016/0305726 A1 * 10/2016 Mokuolu ..... F41A 9/83

* cited by examiner

*Primary Examiner* — Reginald S Tillman, Jr.
(74) *Attorney, Agent, or Firm* — R. Keith Harrison

(57) ABSTRACT

A firearm magazine loading apparatus includes an apparatus housing. A cogwheel may be disposed for rotation in the apparatus housing. The cogwheel may include a rounded cogwheel edge and at least one round cavity in the cogwheel edge. The at least one round cavity may be sized and shaped to accommodate one of the firearm rounds and may include an inner cavity surface, a rear cavity surface extending from the inner cavity surface and an outer cavity surface extending from the rear cavity surface parallel to the inner cavity surface. A firearm round feeder may be disposed in communication with the apparatus housing. The firearm round feeder may be configured to accommodate a plurality of firearm rounds. A magazine mount assembly may be disposed in communication with the apparatus housing. The magazine mount assembly may be configured to accommodate the firearm magazine. A cogwheel driving mechanism may drivingly engage the cogwheel for rotation in the apparatus housing.

20 Claims, 18 Drawing Sheets

FIREARM MAGAZINE LOADING APPARATUS

FIELD

Illustrative embodiments of the disclosure relate to apparatuses for loading firearm rounds into a firearm magazine. More particularly, illustrative embodiments of the disclosure relate to a firearm magazine loading apparatus which is suitable for expeditiously loading multiple firearm rounds into a small firearms magazine.

SUMMARY

Illustrative embodiments of the disclosure are generally directed to a firearm magazine loading apparatus for loading firearm rounds into a firearm magazine. An illustrative embodiment of the firearm magazine loading apparatus includes an apparatus housing. A cogwheel may be disposed for rotation in the apparatus housing. The cogwheel may include a rounded cogwheel edge and at least one round cavity in the cogwheel edge. The at least one round cavity may be sized and shaped to accommodate one of the firearm rounds and may include an inner cavity surface, a rear cavity surface extending from the inner cavity surface and an outer cavity surface extending from the rear cavity surface parallel to the inner cavity surface. A firearm round feeder may be disposed in communication with the apparatus housing. The firearm round feeder may be configured to accommodate a plurality of firearm rounds. A magazine mount assembly may be disposed in communication with the apparatus housing. The magazine mount assembly may be configured to accommodate the firearm magazine. A cogwheel driving mechanism may drivingly engage the cogwheel for rotation in the apparatus housing.

BRIEF DESCRIPTION OF THE DRAWINGS

Illustrative embodiments of the disclosure will now be described, by way of example, with reference to the accompanying drawings, wherein.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
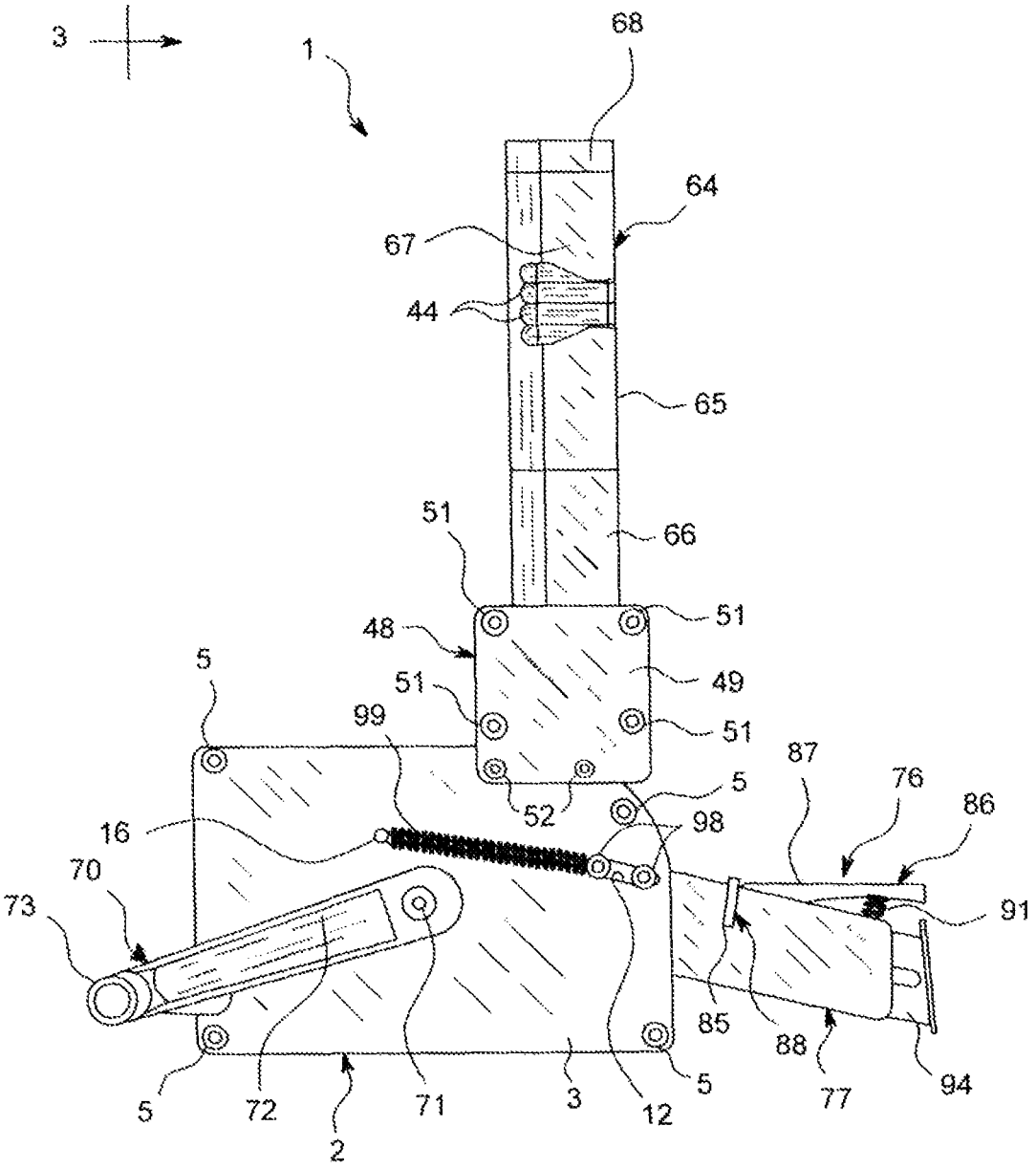
FIG. 1 is a front view of an illustrative embodiment of the firearm magazine loading apparatus, with a firearm round feeder (partially in section) and a magazine mount assembly attached to an apparatus housing in typical operation of the apparatus.
Figure 2:
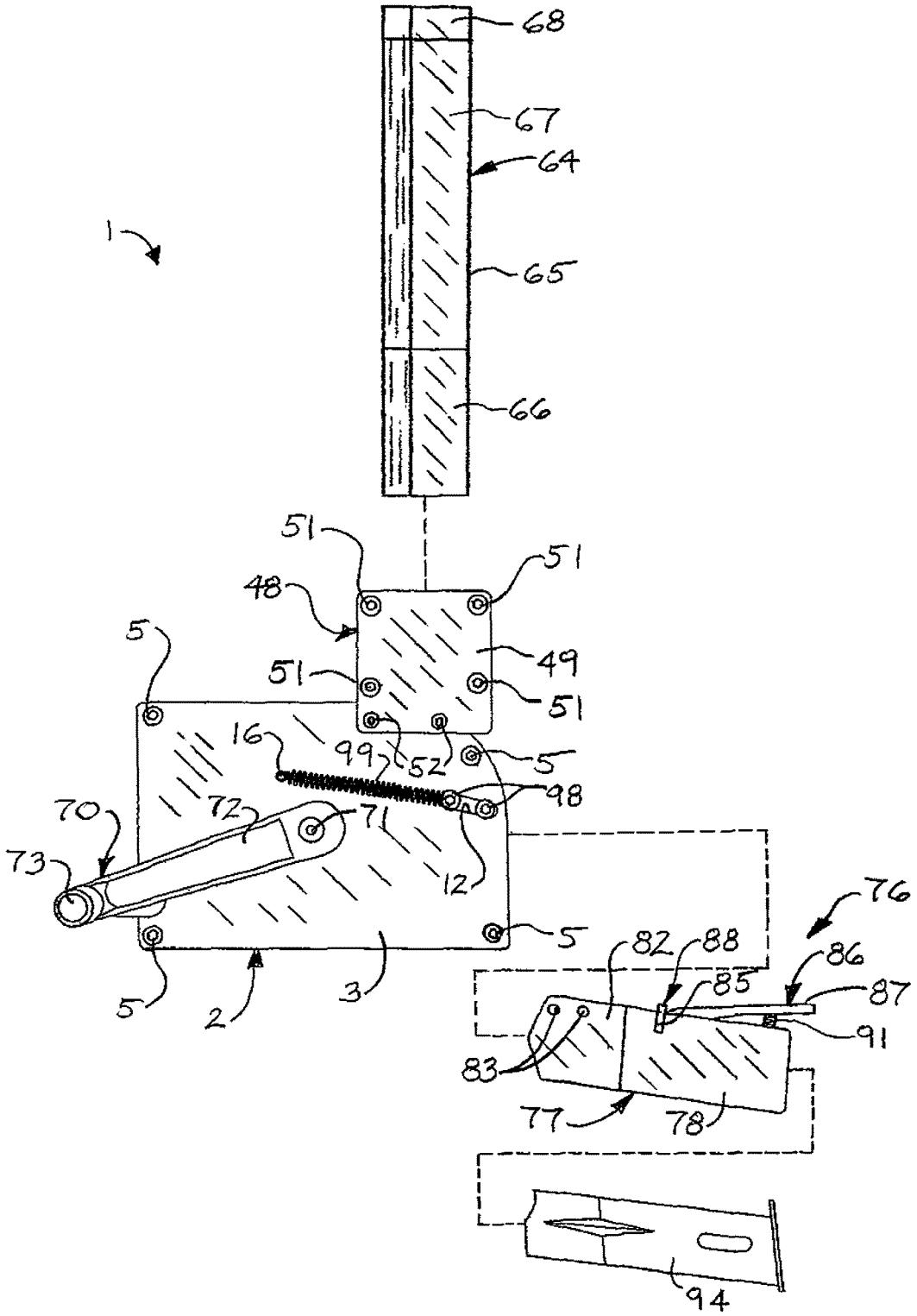
FIG. 2 is an exploded front view of the apparatus, with the firearm round feeder and the magazine mount assembly detached from the apparatus housing and a firearm magazine detached from the magazine mount assembly.
Figure 3:
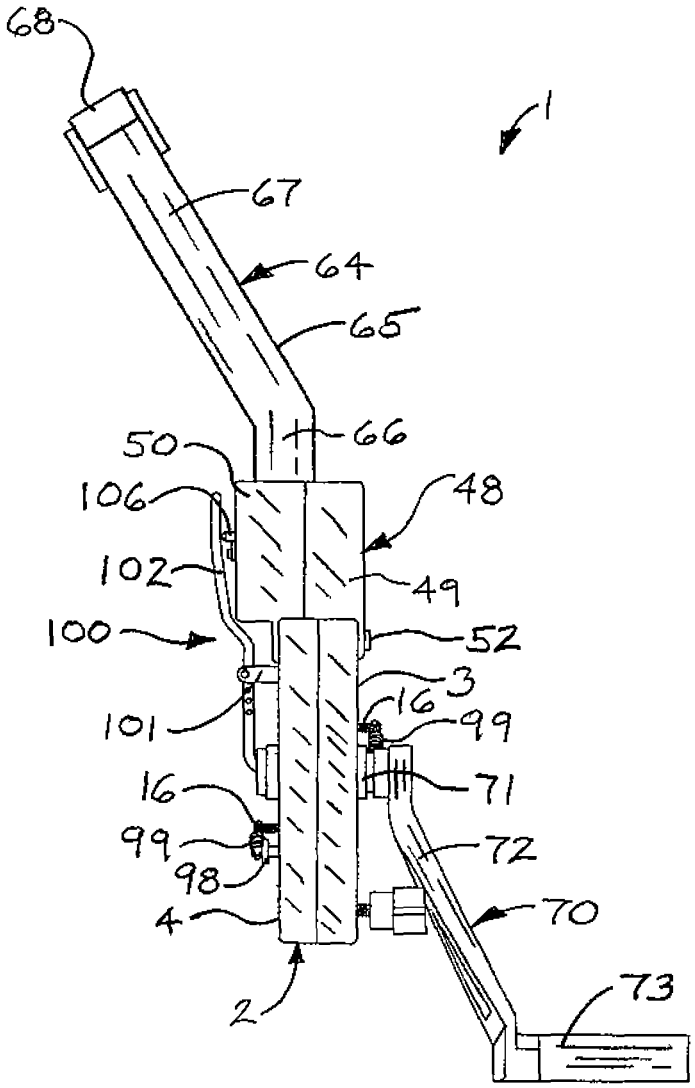
FIG. 3 is a right side view of the apparatus, taken along viewing lines 3-3 in FIG. 1, with the firearm round feeder attached to the apparatus housing.

Referring to the drawings, an illustrative embodiment of the firearm magazine loading apparatus, hereinafter apparatus, is generally indicated by reference numeral 1. As illustrated in FIGS. 1-3, in typical application of the apparatus 1, which will be hereinafter described, multiple firearm rounds 44 may be sequentially loaded into a firearm magazine 94 by operation of the apparatus 1. In some applications, the firearm rounds 44 may include 9 mm rounds for pistols and small firearms. However, it will be recognized and understood that the apparatus 1 can be suitably sized and adapted to accommodate and facilitate loading of firearm rounds 44 of various calibers and sizes in a variety of firearm magazines 94 for different types of firearms. Accordingly, the apparatus 1 may include an apparatus housing 2. A feeder housing 48 may be provided on the apparatus housing 2. A firearm round feeder 64 may be nested, seated, inserted into or otherwise placed into engagement with the feeder housing 48. The firearm round feeder 64 may contain a supply of the firearm rounds 44. A magazine mount assembly 76 may be provided on the apparatus housing 2. The magazine mount assembly 76 may include a magazine receptacle 77. The firearm magazine 94 may be removably or detachably inserted in the magazine receptacle 77. Accordingly, by operation of the apparatus 1, the firearm rounds 44 may be sequentially loaded from the firearm round feeder 64 into the firearm magazine 94 until the firearm magazine 94 is filled to capacity.

Figure 4:
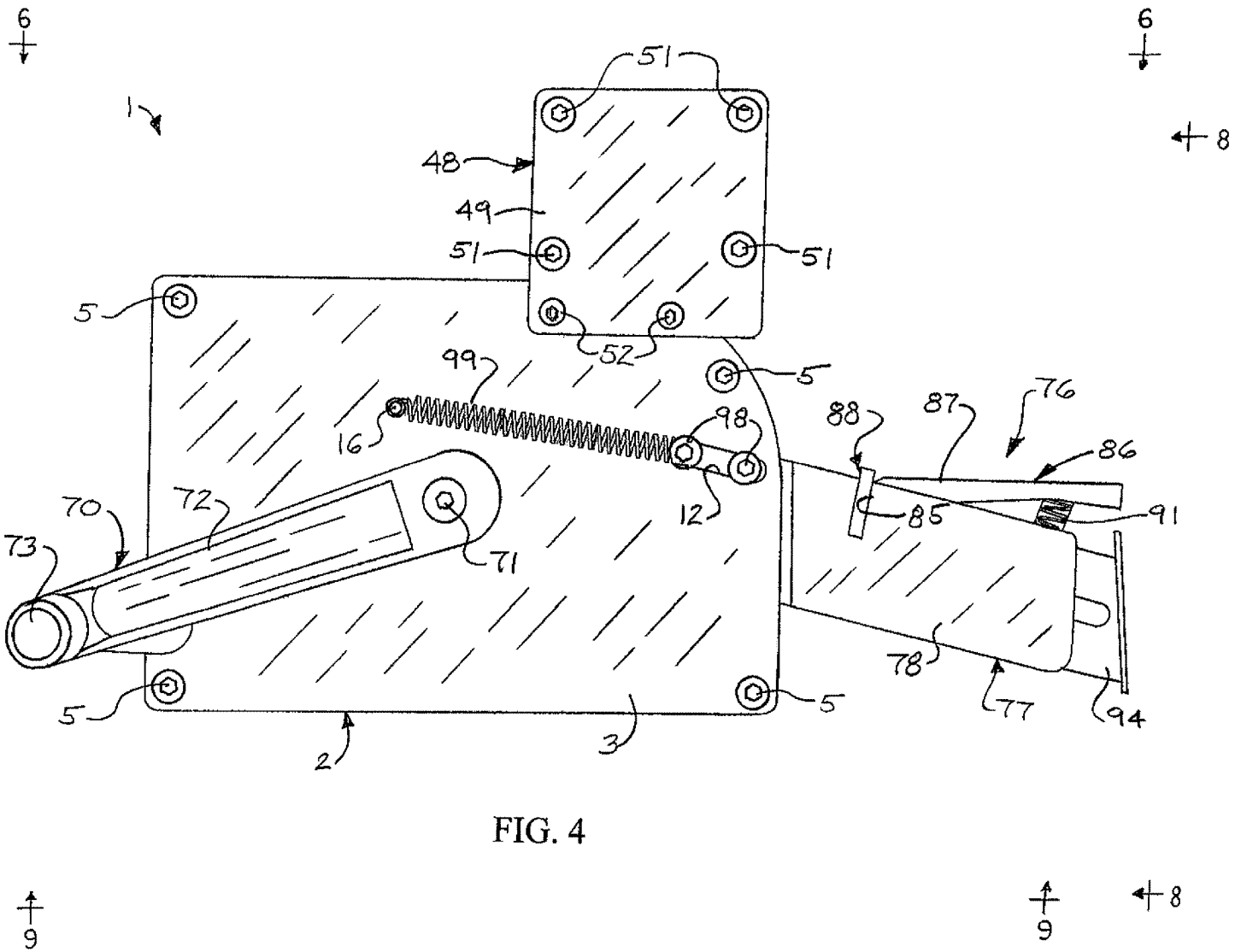
FIG. 4 is an enlarged front view of the apparatus with the firearm round feeder detached from the apparatus housing.
Figure 5:
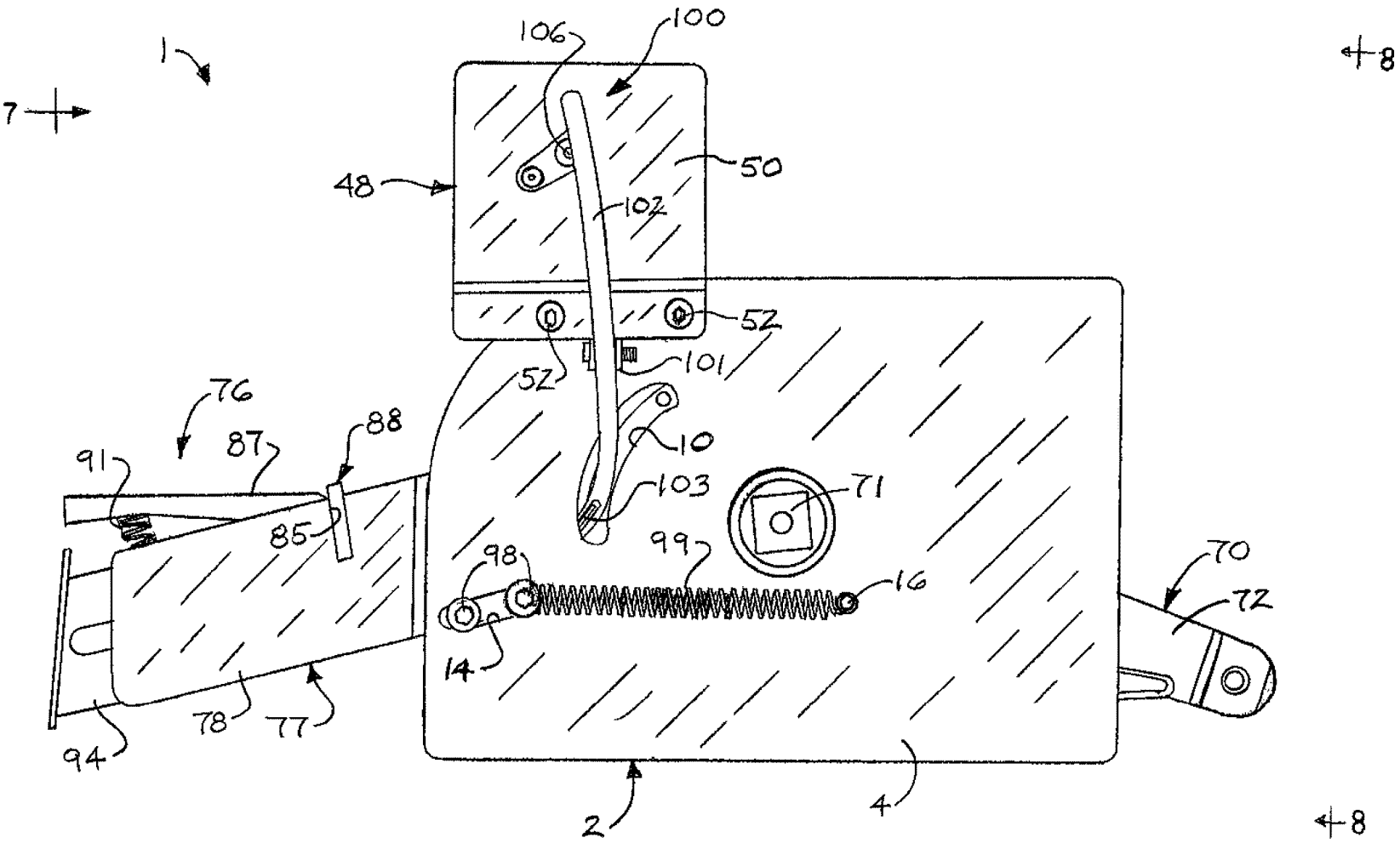
FIG. 5 is an enlarged rear view of the apparatus with the firearm round feeder detached from the apparatus housing.

As illustrated in FIGS. 4 and 5, the apparatus housing 2 may be elongated and generally rectangular in shape. In some embodiments, the apparatus housing 2 may include a front apparatus housing plate 3 and a rear apparatus housing plate 4 which may be mated together according to the knowledge of those skilled in the art. In some embodiments, multiple housing plate fasteners 5 may secure the rear apparatus housing plate 4 to the front apparatus housing plate 3 in the apparatus housing 2. As illustrated in FIG. 5, an lever slot 10, which may be generally curved or arcuate in shape, may extend through the rear apparatus housing plate 4 of the apparatus housing 2 for purposes which will be hereinafter described. A front receptacle spring slot 12 (FIG. 4) and a rear receptacle spring slot 14 (FIG. 5) may extend through the front apparatus housing plate 3 and the rear apparatus housing plate 4, respectively, for purposes which will be hereinafter described. A receptacle spring mount 16 may protrude from each of the front apparatus housing plate 3 and the rear apparatus housing plate 4 in spaced-apart relationship to the front receptacle spring slot 12 and the rear receptacle spring slot 14, respectively, for purposes which will be hereinafter described.

As illustrated in FIGS. 18-22, a cogwheel cavity 18 may be provided in the interior surface of the rear housing plate 4. The cogwheel cavity 18 may include a round inlet area 19, a round transport area 20 and around discharge area 21. A magazine insert cavity 24 may communicate with the round discharge area 21 of the cogwheel cavity 18. The magazine insert cavity 24 may be suitable sized and configured to accommodate the magazine receptacle 77 of the magazine mount assembly 76, as will be hereinafter further described.

Figure 17:
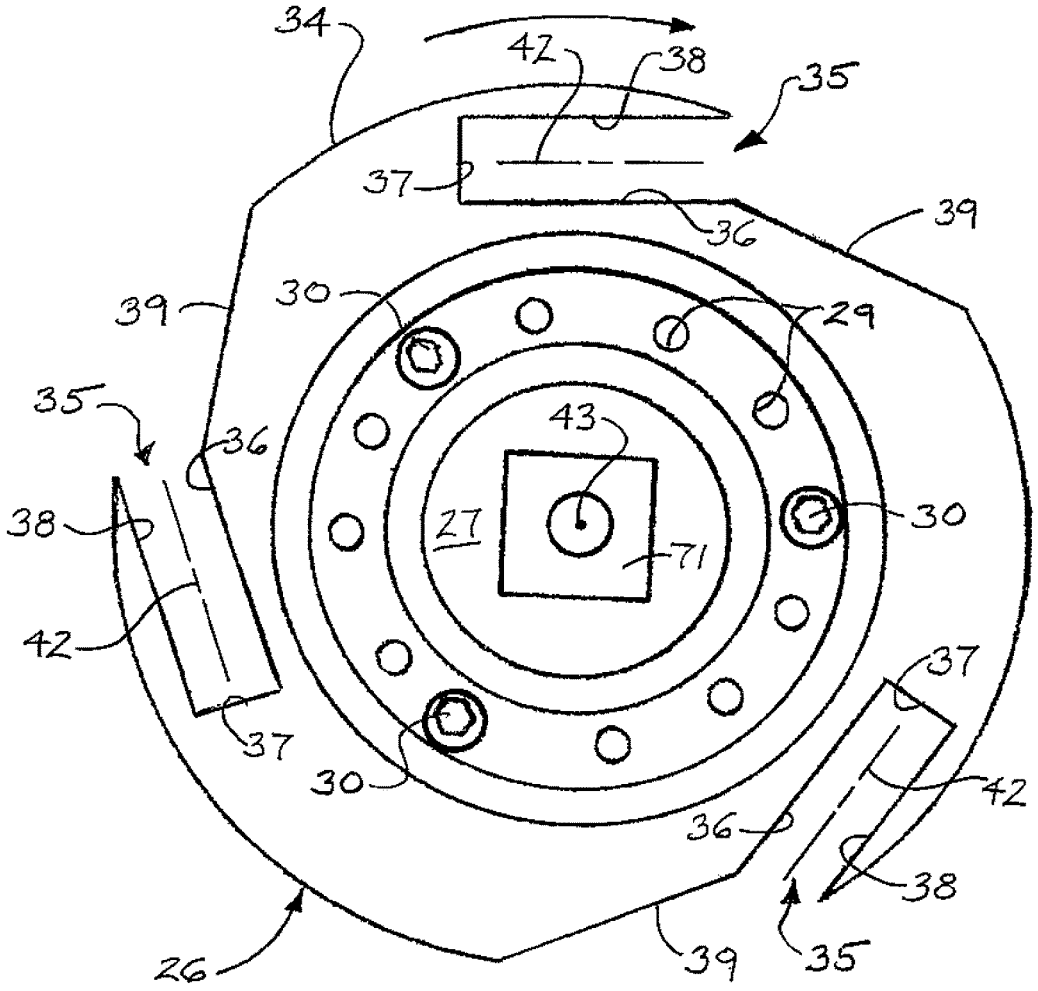
FIG. 17 is a front view of a typical cogwheel of the apparatus.

As further illustrated in FIGS. 18-22, a cogwheel 26 may be disposed for rotation within the cogwheel cavity 18. As illustrated in FIG. 17, the cogwheel 26 may be generally circular and may include a cogwheel hub 27 and a rounded cogwheel edge 34. At least one round cavity 35 may extend into the cogwheel edge 34 of the cogwheel 26. In some embodiments, three discrete round cavities 35 may extend into the cogwheel edge 34 of the cogwheel 26 in spaced-apart relationship to each other along the circumference of the cogwheel 26, as illustrated. In other embodiments, the cogwheel 26 may have less than or more than three round cavities 35. Each round cavity 35 may be generally elongated and rectangular in shape. Each round cavity 35 may include an inner cavity surface 36, a rear cavity surface 37 and an outer cavity surface 38 which may be parallel to the inner cavity surface 36. A cavity inlet bevel 39 may be provided in the cogwheel edge 34 adjacent and at an obtuse angle with respect to the inner cavity surface 36 of each round cavity 35. Each round cavity 35 may have a longitudinal cavity axis 42 which is perpendicular to a rotational axis 43 of the cogwheel 26. Multiple hub openings 29 may be provided in the cogwheel hub 27. At least one reverse inhibitor bolt 30 may be threaded into at least one of the hub openings 29. In some embodiments, multiple reverse inhibitor bolts 30 which generally correspond in position to the respective round cavities 35 may be provided on the cogwheel hub 27 for purposes which will be hereinafter described.

A cogwheel driving mechanism 70 may engage the cogwheel 26 for rotation of the cogwheel 26 within the cogwheel cavity 18 in the apparatus housing 2. In some embodiments, the cogwheel driving mechanism may include a crank 70. The crank 70 may include a crank bolt 71 which drivingly engages the cogwheel hub 27 for rotation of the cogwheel 26. An elongated crankshaft 72 may extend from the crank bolt 71. A rotatable crank handle 73 may terminate the crank shaft 72. Accordingly, responsive to manual rotation of the crank handle 73, the crank shaft 72 may rotate the crank bolt 71, which rotates the cogwheel 26 in the cogwheel cavity 18, typically in the clockwise direction indicated in FIG. 17. In other embodiments, the cogwheel driving mechanism 70 may include a motor (not illustrated) which may drivingly engage the cogwheel hub 27 of the cogwheel 26 for rotation of the cogwheel 26 in the cogwheel cavity 18.

In some embodiments, the feeder housing 48 may include a front feeder housing plate 49 and a rear feeder housing plate 50 which may be attached to the front apparatus housing plate 3 and the rear apparatus housing plate 4, respectively, of the apparatus housing 2. Housing plate fasteners 51 may attach the front feeder housing plate 49 to the rear feeder housing plate 50. Housing attachment fasteners 52 may attach the front feeder housing plate 49 to the front apparatus housing plate 3 of the apparatus housing 2 and the rear feeder housing plate 50 to the rear apparatus housing plate 4 of the apparatus housing 2.

As illustrated in FIGS. 18-22, a feeder receptacle cavity 54 may be provided in the interior surfaces of the front feeder housing plate 49 and the rear feeder housing plate 50 of the feeder housing 48. The feeder receptacle cavity 54 may be sized and configured to accommodate an insertion end of the firearm round feeder 64. A round inlet cavity 58 may be provided in the interior surfaces of the front feeder housing plate 49 and the rear feeder housing plate 50. The round inlet cavity 58 may be generally triangular in shape and may be disposed adjacent to the round inlet area 19 of the cogwheel cavity 18 in the apparatus housing 2. The round inlet cavity 58 may have a round orienting surface 59 which is disposed in facing and angular relationship to the feeder receptacle cavity 54 and the discharge end of the firearm round feeder 64.

The firearm round feeder 64 of the apparatus 1 may include a generally elongated feeder housing 65. The feeder housing 65 may include a feeder base portion 66 and a feeder body portion 67. As illustrated in FIG. 3, in some embodiments, the feeder body portion 67 may be disposed at an angle with respect to the feeder base portion 66. The feeder housing 65 may be suitably sized and configured to contain a selected number of the firearm rounds 44 (FIG. 1) in vertically-adjacent or stacked relationship to each other. As illustrated in FIG. 1, in typical application of the apparatus 1, which will be hereinafter described, the firearm round feeder 64 may be oriented in a vertical position. Accordingly, the rounds 44 may sequentially fall from the firearm round feeder 64 into the round inlet cavity 58 (FIG. 18) in the feeder housing 48. The firearm rounds 44 may engage the round orienting surface 59 of the round inlet cavity 58 in the feeder housing 48. The round orienting surface 59 may properly orient the rounds 44 as they sequentially fall into the respective round cavities 35 and the cogwheel edge 34 of the cogwheel 26 as the cogwheel 26 is rotated in the cogwheel cavity 18 typically by operation of the crank 70.

Figure 11:
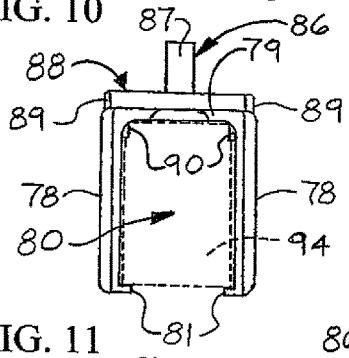
FIG. 11 is a left view of the magazine receptacle with the inserted magazine illustrated in phantom and the magazine retaining mechanism disposed in the magazine-retaining configuration.

As illustrated in FIGS. 10-16, the magazine receptacle 77 of the magazine mount assembly 76 may be generally elongated in rectangular in shape. The magazine receptacle 77 may include a pair of spaced-apart receptacle walls 78. A receptacle connecting wall 79 may connect the receptacle walls 78. A receptacle interior 80 (FIG. 13) may be formed by and between the receptacle walls 78 and the receptacle connecting wall 79. The receptacle interior 80 may be suitably sized and configured to receive and accommodate the firearm magazine 94. Accordingly, a pair of receptacle flanges 81 may protrude from the respective receptacle walls 78 to engage and retain the firearm magazine 94 in the magazine receptacle 77, as illustrated in FIG. 11. The magazine receptacle 77 may have an insertion end 82 which is suitable sized and configured for insertion into the magazine insert cavity 24 (FIGS. 18-22) of the apparatus housing 2. A pair of spaced-apart spring fastener openings 83 may extend through each receptacle wall 78 at the insertion end 82 of the magazine receptacle 77. Accordingly, as illustrated in FIG. 2, the insertion end 82 of the magazine receptacle 77 may be inserted in the magazine insert cavity 24 (FIG. 18) of the apparatus housing 2. As further illustrated in FIG. 2, a receptacle spring fastener 98 may be extended through each of the first receptacles spring slot 12 and the second receptacle spring slot 14 (FIG. 5) in the front housing plate 3 and the rear housing plate 4, respectively, of the apparatus housing 2. The receptacle spring fastener 98 may be further extended or threaded into one of the registering spring fastener openings 83 in the insertion end 82 of the magazine receptacle 77. A receptacle spring 99 may be attached to and extend between the receptacle spring mount 16 and the receptacle spring fastener 98. Accordingly, the receptacle spring 99 may retain the magazine receptacle 77 in the magazine insert cavity 24 of the apparatus housing 2.

Figure 12:
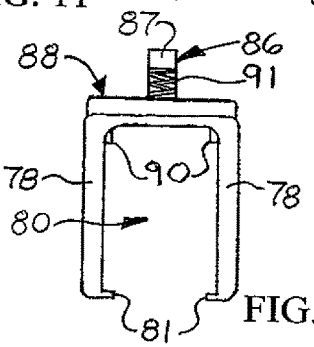
FIG. 12 is a right view of the magazine receptacle with the magazine retaining mechanism disposed in the magazine-retaining configuration.
Figure 14:
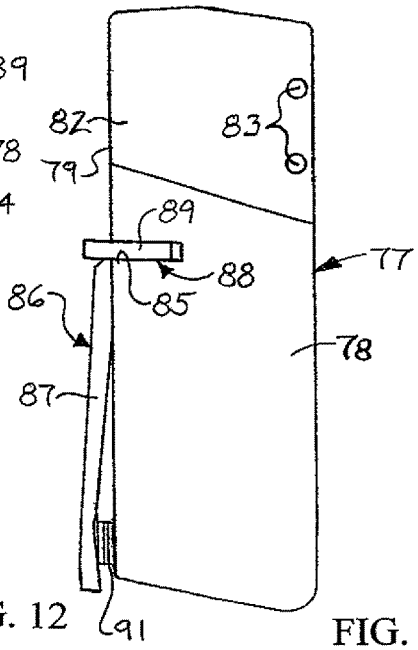
FIG. 14 is a rear view of the magazine receptacle with a magazine retaining mechanism disposed in a magazine-releasing configuration.
Figure 16:
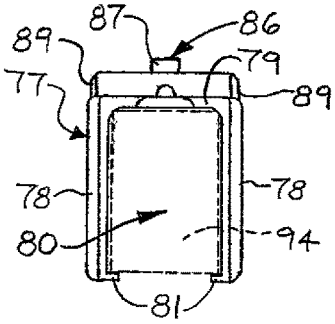
FIG. 16 is a left side view of the magazine receptacle with the magazine illustrated in phantom and the magazine receptacle in the magazine-releasing configuration.

As further illustrated in FIGS. 10-16, the magazine receptacle 77 may include a magazine retaining mechanism 86 which retains the magazine 94 in the receptacle interior 80. In some embodiments, the magazine retaining mechanism 86 may include an elongated magazine retaining lever 87 which is pivotally disposed in an elongated lever spot 84 in the receptacle connecting wall 79 of the magazine receptacle 77. The magazine retaining lever 87 may engage a magazine engaging bracket 88 which is slidably disposed within a bracket slot 85 in the receptacle walls 78 and the receptacle connecting wall 79 of the magazine receptacle 77. The magazine retaining lever 87 may be pivotally disposed between the extended, magazine-retaining position illustrated in FIGS. 10, 11, 12 and 15 and the retracted, magazine-releasing position illustrated in FIGS. 14 and 16. As illustrated in FIGS. 11-12, a pair of bracket arm flanges 90 may extend from a respective pair of bracket arms 89 on the magazine engaging bracket 88. In the extended position of the magazine retaining lever 87, as illustrated in FIG. 11, the bracket arm flanges 90 may engage a respective pair of flange openings (not illustrated) in the firearm magazine 94 to retain the firearm magazine 94 in the receptacle interior 80 of the magazine receptacle 77. Conversely, by pivoting of the magazine retaining lever 87 to the retracted position illustrated in FIG. 14, the bracket arm flanges 90 may disengage the flange openings in the firearm magazine 94, as illustrated in FIG. 16, thereby permitting selective insertion and removal of the firearm magazine 94 with respect to the receptacle interior 80 of the magazine receptacle 77. A lever spring 91 may be interposed between the magazine retaining lever 87 and the receptacle connecting wall 79 of the magazine receptacle 77 to normally maintain the magazine retaining lever 87 in the extended, magazine-retaining position.

As further illustrated in FIGS. 18-22, the firearm magazine 94 may be conventional and may include a magazine platform 95 which is biased by a magazine spring 96. The firearm magazine 94 receives and retains firearm rounds 44 during operation of the apparatus 1, as will be hereinafter described.

Figure 7:
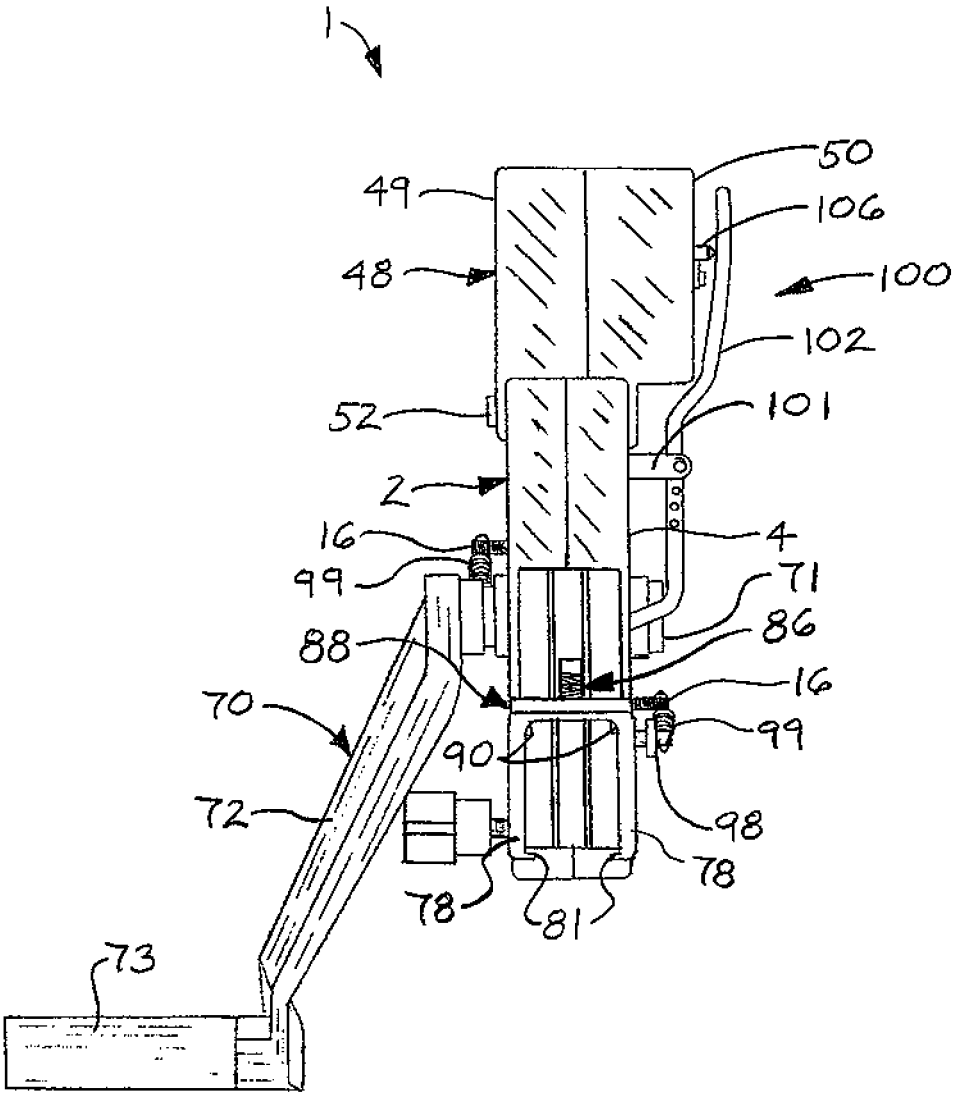
FIG. 7 is a left side view of the apparatus, taken along viewing lines 7-7 in FIG. 5, with the firearm round feeder and the magazine mount assembly detached from the apparatus housing.
Figure 8:
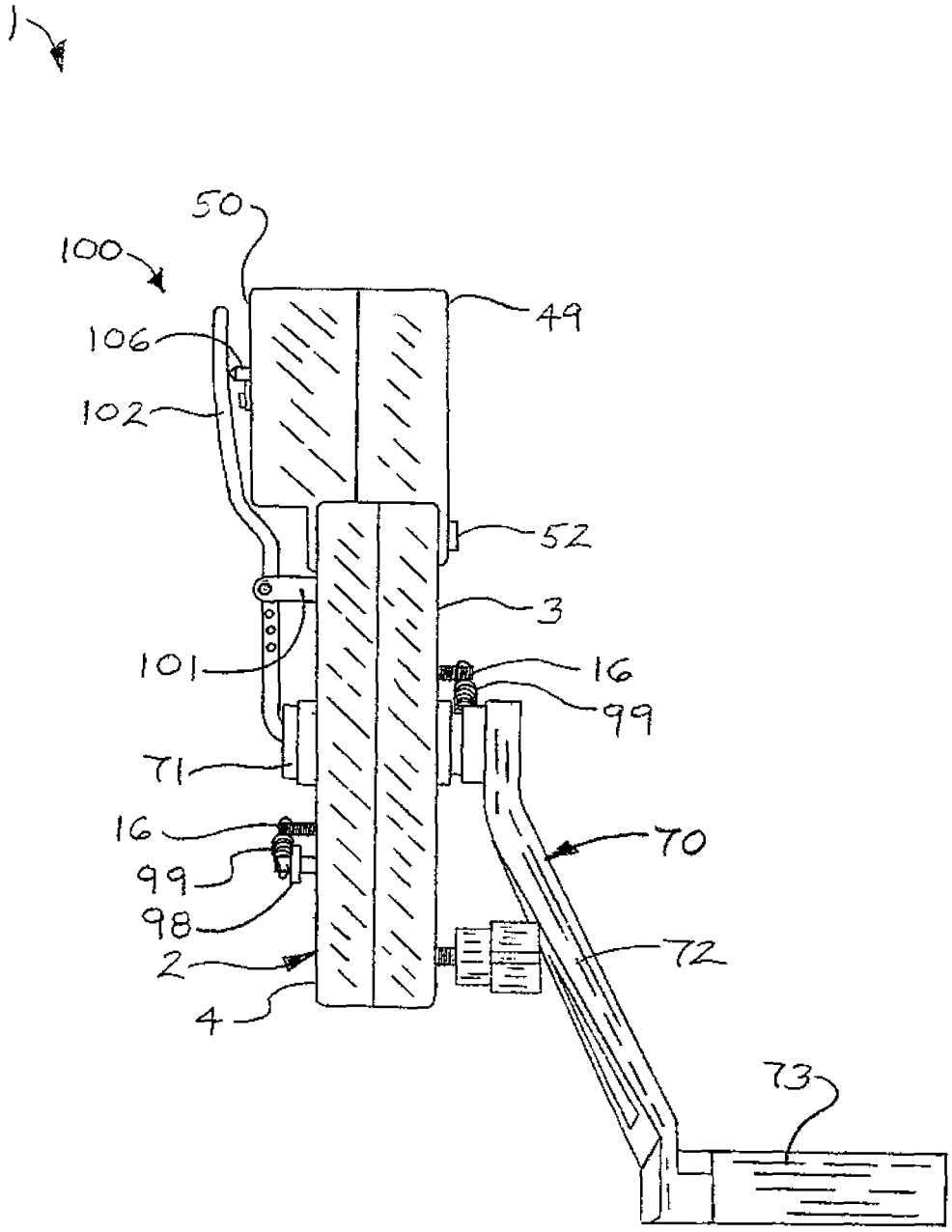
FIG. 8 is a right side view of the apparatus with the feeder detached.
Figure 9:
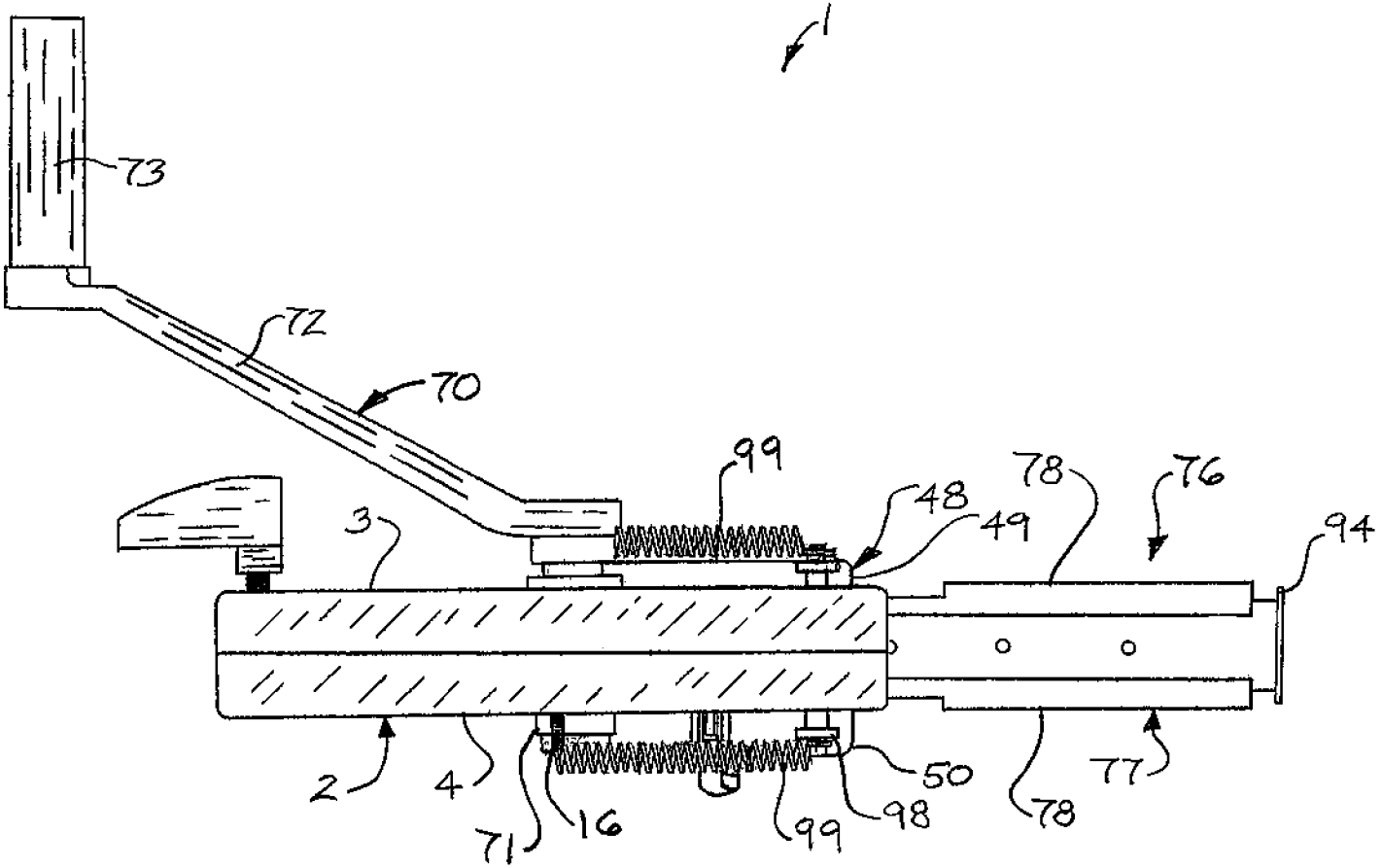
FIG. 9 is a bottom view of the apparatus with a magazine mount assembly and magazine in place.
Figure 10:
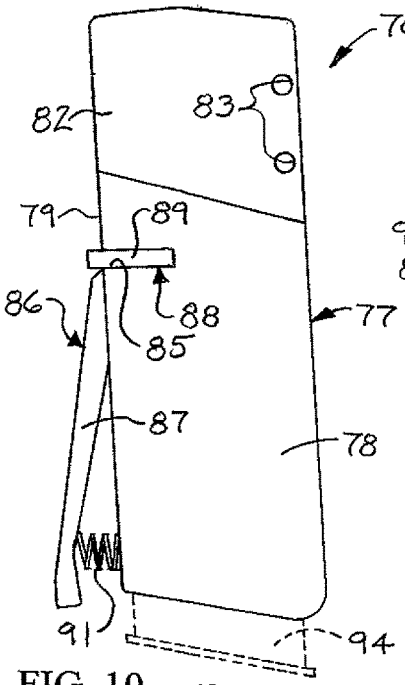
FIG. 10 is a rear view of a typical magazine receptacle of the magazine mount assembly, with the firearm magazine inserted in the magazine receptacle and illustrated in phantom and the magazine retaining mechanism disposed in a magazine-retaining configuration.
Figure 13:
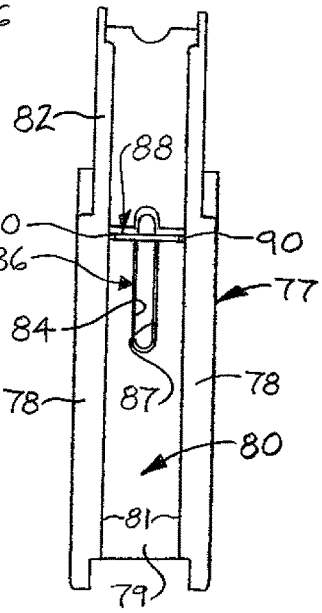
FIG. 13 is a bottom view of the magazine receptacle.
Figure 15:
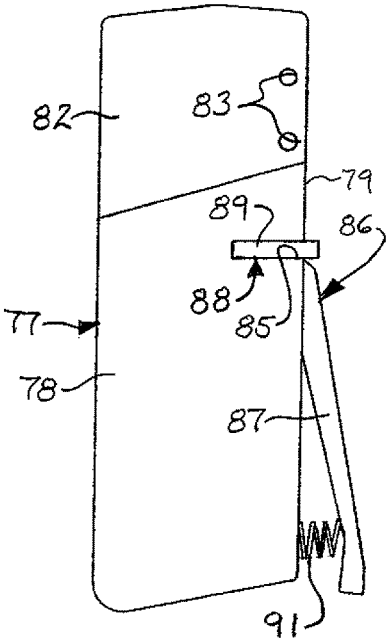
FIG. 15 is a front view of the magazine receptacle with the magazine retaining mechanism in the magazine-retaining configuration.
Figure 23:
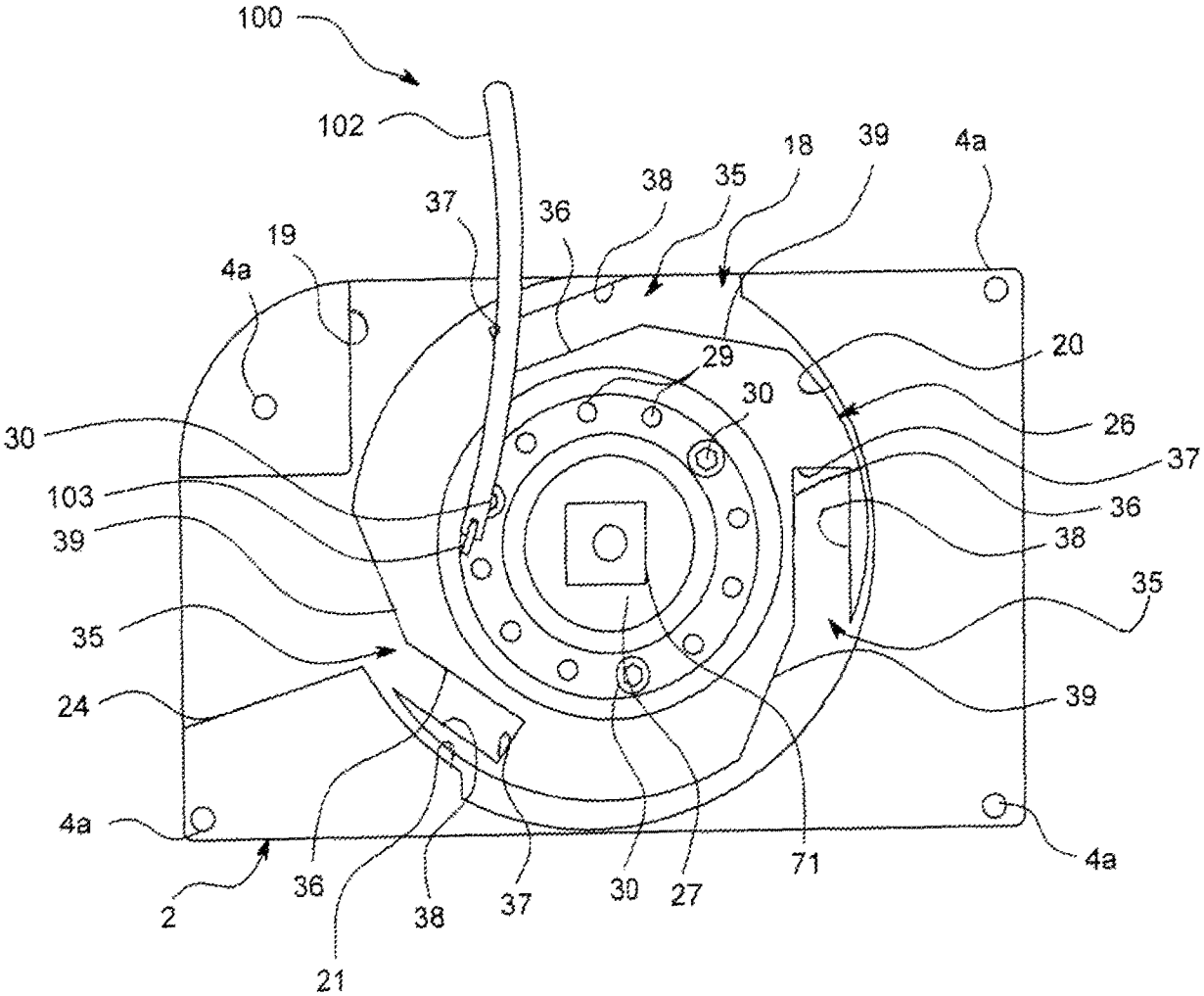
FIG. 23 is an interior view of the apparatus housing, more particularly illustrating a reverse inhibiting mechanism which includes an elongated reverse inhibiting lever deployed in place adjacent to the cogwheel.

As illustrated in FIGS. 5, 7, 8 and 23-26 of the drawings, in some embodiments, a reverse inhibiting mechanism 100 may prevent reverse rotation of the cogwheel 26 in the apparatus housing 2. Accordingly, as illustrated in FIGS. 5, 7 and 8, in some embodiments, the reverse inhibiting mechanism 100 may include a lever fulcrum 101 which may be provided on the front housing plate 3 or the rear housing plate 4, as illustrated, of the apparatus housing 2. An elongated reverse inhibiting lever 102 may be pivotally mounted on the lever fulcrum 101. As illustrated in FIG. 5, an extending or distal end of the reverse inhibiting lever 102 may extend through the lever slot 10 in the rear housing plate 4 of the apparatus housing 2. A lever wheel 103 may be rotatably mounted at the end of the reverse inhibiting lever 102 inside the apparatus housing 2. As illustrated in FIG. 23, the lever wheel 103 may be disposed in engagement with the cogwheel hub 27 of the cogwheel 26 and in the rotational path of the reverse inhibitor bolts 30.

Figure 24:
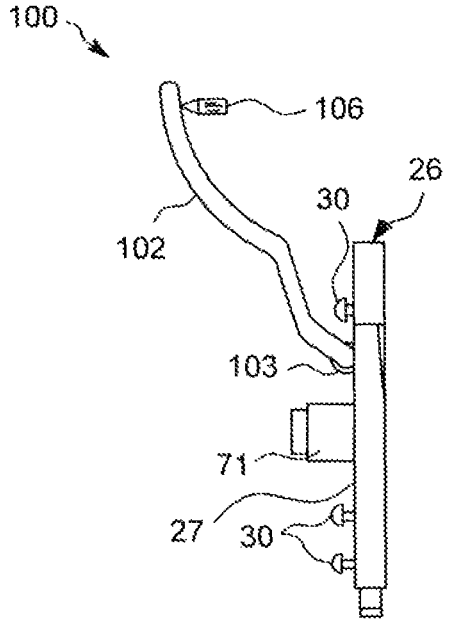
FIGS. 24-26 illustrate engagement between the reverse inhibiting lever and a reverse inhibiting bolt on the cogwheel to prevent reverse rotation of the cogwheel in the apparatus housing.
Figure 25:
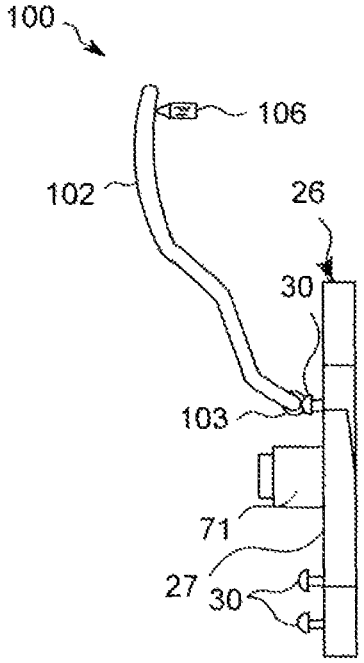

As illustrated in FIGS. 7 and 8, a spring-loaded lever pin 106 may protrude from the rear housing plate 50 of the feeder housing 48. The lever pin 106 may engage and normally bias the reverse inhibiting lever 102 in a cogwheel-engaging position in which the lever wheel 103 engages the cogwheel hub 27, as illustrated in FIG. 24. In forward rotation of the cogwheel 26, each time one of the reverse inhibitor bolts 30 on the rotating cogwheel 26 engages the lever wheel 103, as illustrated in FIG. 25, the reverse inhibitor bolt 30 may pivot the reverse inhibiting lever 102 from the cogwheel-engaging position of FIG. 24 to the bolt-engaging position of FIG. 25, against the spring-loaded bias of the lever pin 106, thereby permitting continued forward rotation of the cogwheel 26. Upon continued forward rotation of the cogwheel 26, the lever pin 106 may return the reverse inhibiting lever 102 to the cogwheel-engaging position illustrated in FIG. 26 such that the lever wheel 103 again engages the cogwheel hub 27.

In the event of reverse rotation of the cogwheel 26 in the cogwheel cavity 18, such as by reverse rotation of the crank 70, the lever wheel 103 engages one of the reverse inhibitor bolts 30, preventing reverse rotation and jamming of the cogwheel 26. In other embodiments, the reverse inhibiting mechanism 100 may have alternative designs which are suitable to prevent reverse rotation of the cogwheel 26 in the apparatus housing 2.

Figure 6:
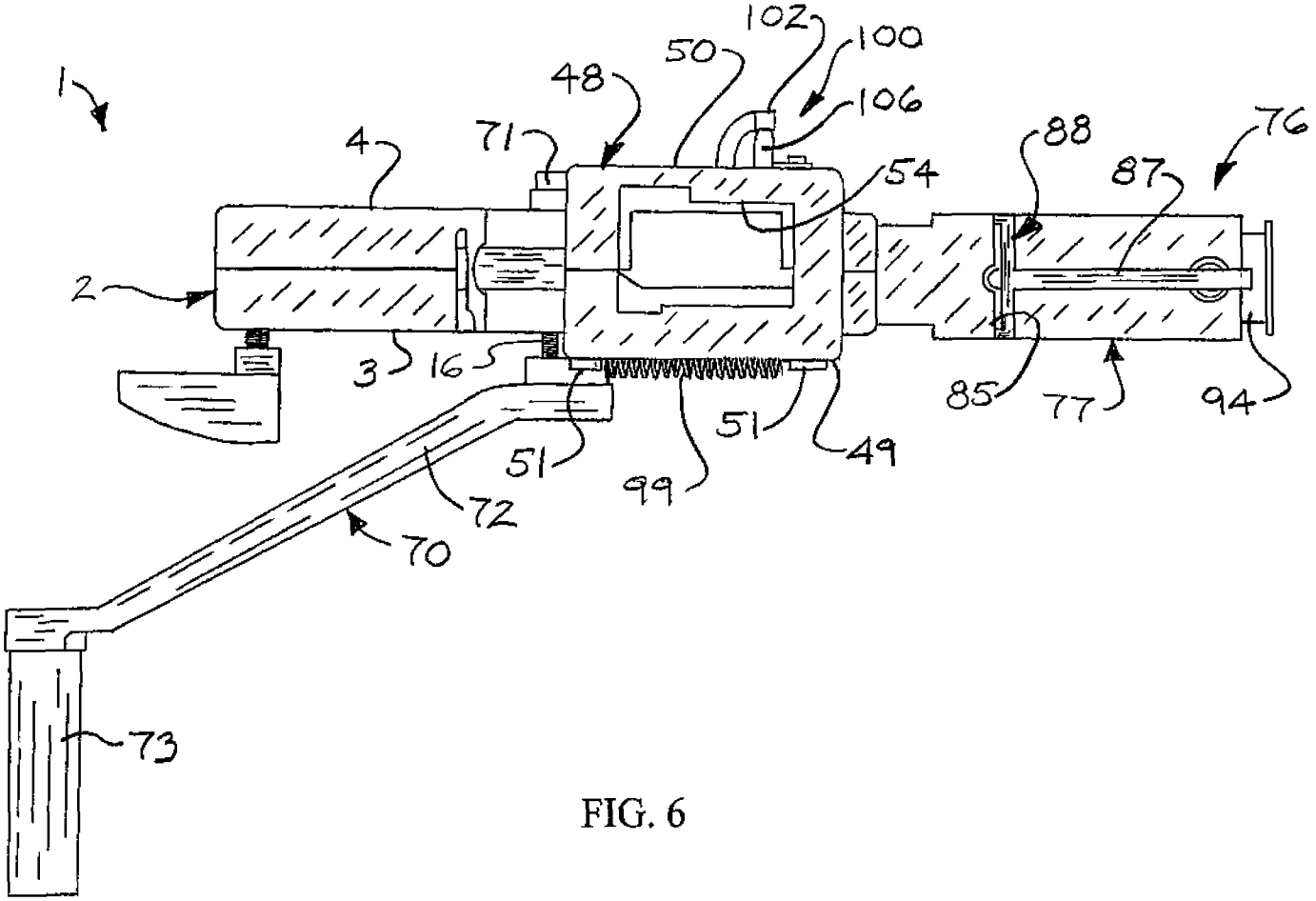
FIG. 6 is a top view of the apparatus, taken along viewing lines 6-6 in FIG. 4, with the firearm round feeder detached from the apparatus housing.

Referring next to FIGS. 1-3 and 18-24 of the drawings, in typical application, multiple firearm rounds 44 may be placed in the firearm round feeder 64. In some embodiments, a detachable feeder cap 68 may be provided on the firearm round feeder 64 to facilitate opening of the firearm round feeder 64 and placement of the firearm rounds 44 in the firearm round feeder 64. The feeder base portion 66 of the firearm round feeder 64 may be inserted in the companion feeder receptacle cavity 54 (FIG. 6) in the feeder housing 48. An empty firearm magazine 94 may be inserted in the magazine receptacle 77 of the magazine mount assembly 76. As illustrated in FIG. 2, the insertion end 82 of the magazine receptacle 77 may be inserted in the magazine insert cavity 24 (FIG. 18) in the apparatus housing 2. As illustrated in FIGS. 1-3, the apparatus housing 2 may be oriented such that the firearm round feeder 64 is disposed in the vertical configuration above the feeder housing 48.

Figure 18:
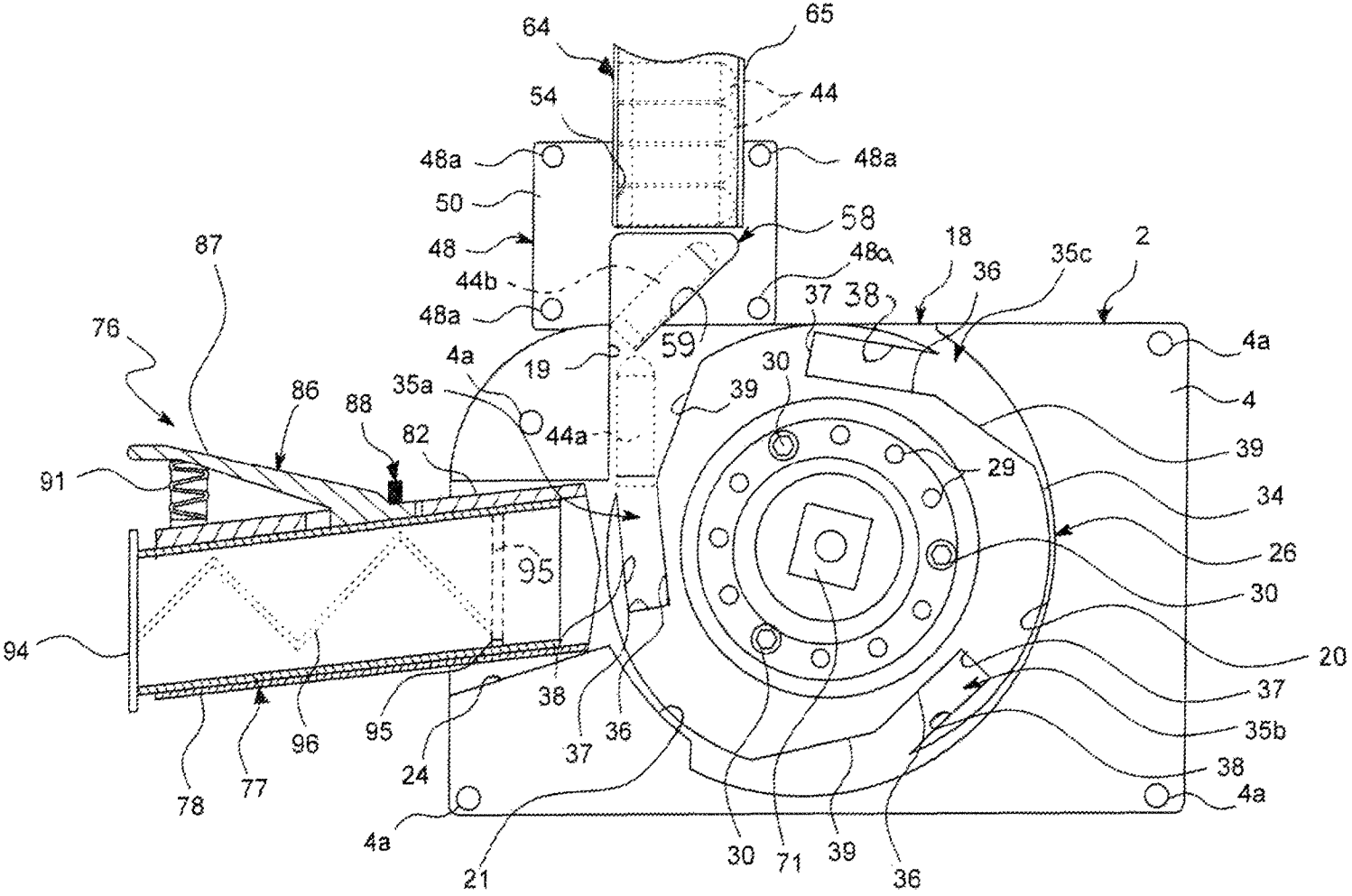
FIG. 18 is an interior view of the apparatus housing of the apparatus, with the cogwheel in place inside the apparatus housing, more particularly illustrating typical loading of rounds from the firearm round feeder into the firearm magazine in typical operation of the apparatus.

As illustrated in FIG. 18, the cogwheel 26 may next be rotated, typically in the clockwise direction (FIG. 17), by operation of the hand crank 70. Accordingly, the cogwheel 26 may rotate in the cogwheel cavity 18 inside the apparatus housing 2. The firearm rounds 44 may sequentially fall from the firearm round feeder 64 initially into the underlying round inlet cavity 58 of the feeder housing 48. The firearm rounds 44 may engage the sloped or angled round orienting surface 59 in the round inlet cavity 58 such that the firearm rounds 44 fall or slide from the round orienting surface 59 through the round inlet area 19 of the cogwheel cavity 18 into an underlying and registering round cavity 35 in the cogwheel edge 34 of the cogwheel 26.

Figure 19:
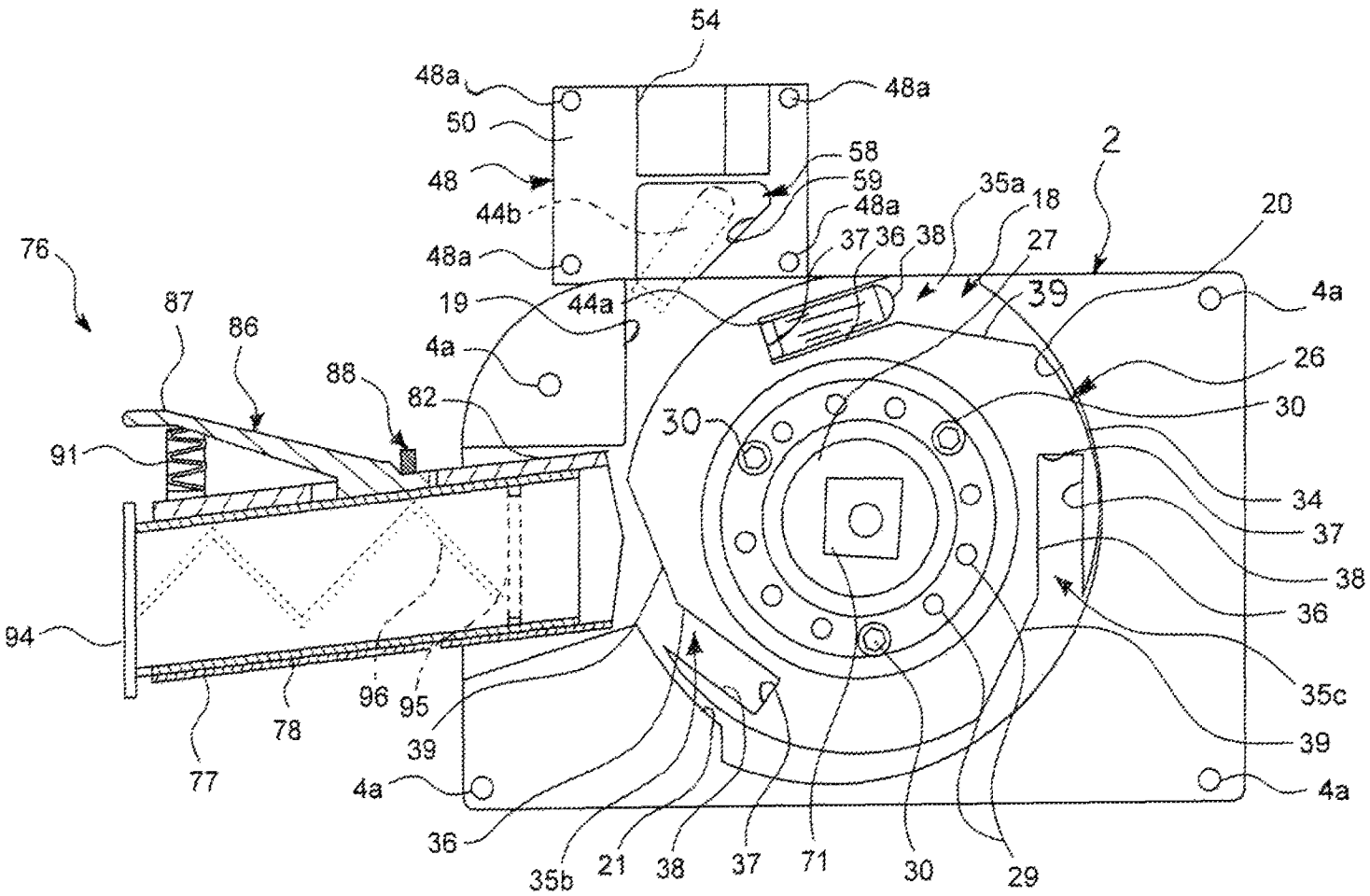
FIGS. 19-22 are interior views of the apparatus housing, more particularly illustrating sequential loading of firearm rounds into the firearm magazine.
Figure 20:
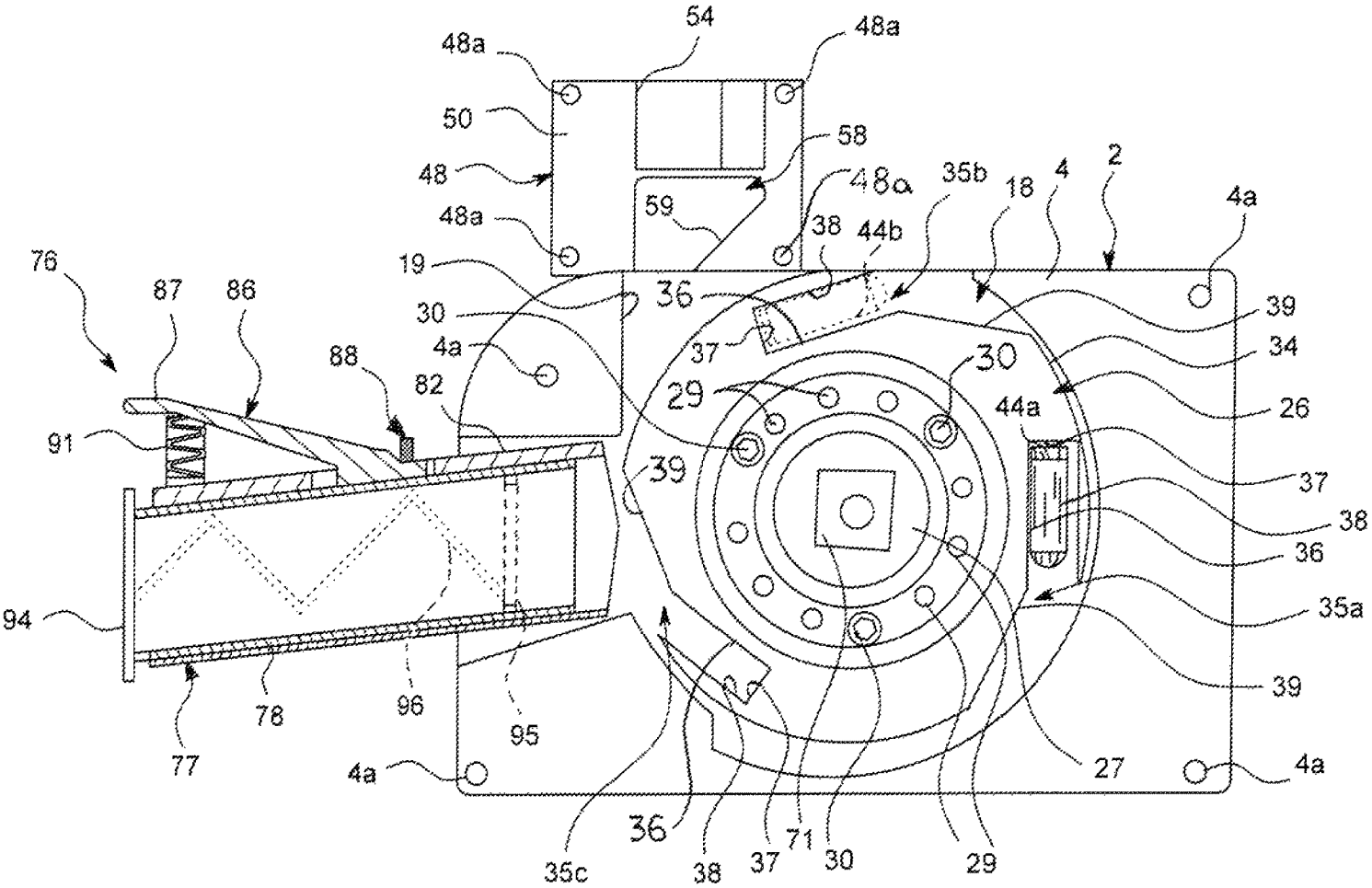
Figure 21:
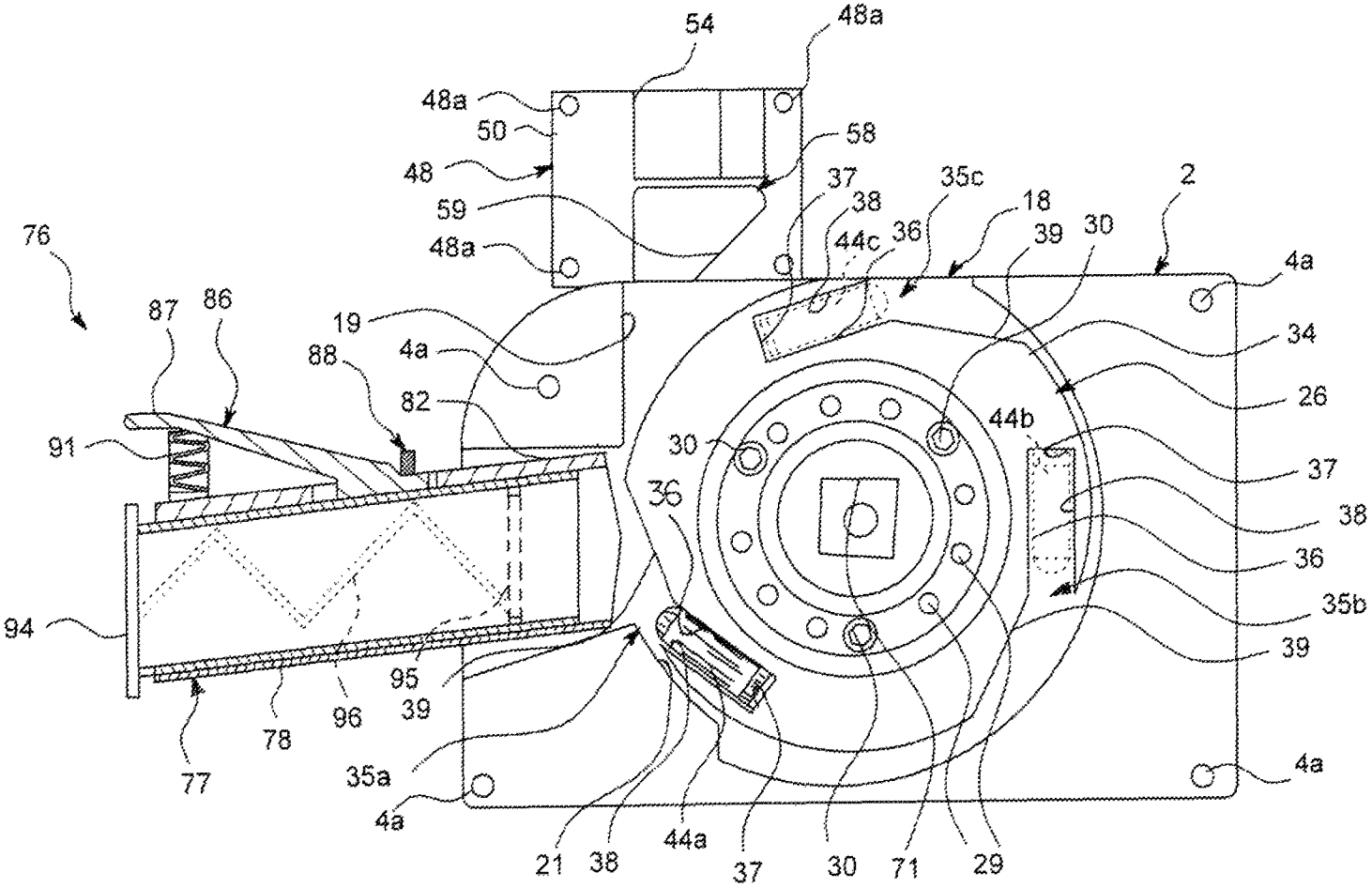
Figure 22:
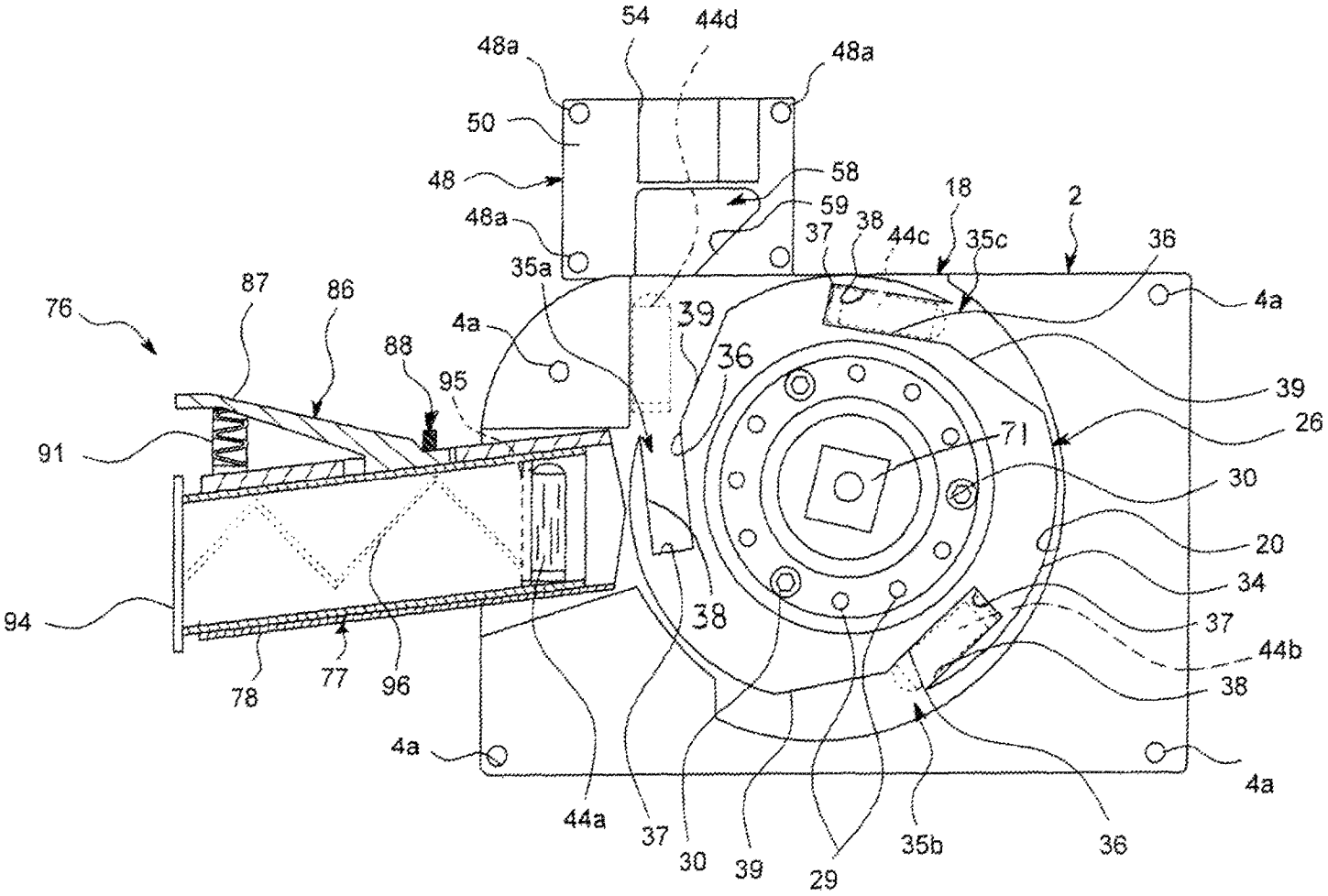

In the non-limiting example illustrated in FIGS. 18-22, a first firearm round 44*a* falls from the firearm round feeder 64 through the round inlet cavity 58 and the round inlet area 19 of the cog wheel cavity 18, respectively, and into an underlying and registering first round cavity 35*a* in the cogwheel 26 (FIG. 18). As the crank 70 is operated to rotate the cogwheel 26 typically in the clockwise direction, the first round cavity 35*a*, which now contains the first firearm round 44*a*, transitions from the round inlet area 19 toward the round transport area 20 of the cogwheel cavity 18, as illustrated in FIG. 19. Simultaneously, a second round cavity 35*b* transitions from the round discharge area 21 to the round inlet area 19 of the cogwheel cavity 18. As illustrated in FIGS. 19 and 20, a second firearm round 44*b* falls from the firearm round feeder 64 through the round inlet cavity 58 and the round inlet area 19 of the cogwheel cavity 18, and into an underlying and registering second round cavity 35*b* in the cogwheel 26. Upon continued rotation of the crank 70, the first round cavity 35*a* continues to transition around the cogwheel cavity 18 to the round discharge area 21 of the cogwheel cavity 18, as illustrated in FIGS. 20 and 21. Continued rotation of the crank 70 causes the first round cavity 35*a* to deposit or discharge the first firearm round 44*a* into the firearm magazine 94 in the magazine mount assembly 76, as illustrated in FIG. 22, typically at approximately 110 degrees. As the cogwheel 26 continues to rotate, the cogwheel edge 34 of the cogwheel 26 may engage and push the first firearm round 44*a* against the spring-loaded magazine platform 95 in the firearm magazine 94, thereby loading the first firearm round 44*a* into the firearm magazine 94. The firearm magazine 94 may retain the first firearm round 44*a* therein typically in the conventional manner. Simultaneously, the second round cavity 35*b* continues to transition the second firearm round 44*b* from the round transport area 20 toward the round discharge area 21 of the cogwheel cavity 18, and a third round cavity 35*c* receives a third firearm round 44*c* from the round inlet cavity 58 at the round inlet area 19. Continued clockwise rotation of the cogwheel 26 results in sequential discharge of the second firearm round 44*b* and the third firearm round 44*c*, respectively, into the firearm magazine 94 as the second round cavity 35*b* and the third round cavity 35*c* sequentially arrive at the round discharge area 21 of the cogwheel cavity 18. After the second firearm round 44*b* and the third firearm round 44*e* are discharged from the second round cavity 35*b* and the third round cavity 35*c*, respectively, the cogwheel edge 34 typically pushes the second firearm round 44*b* and the third firearm round 44*c* into the firearm magazine 94 against the spring-loaded bias of the magazine platform 95. The process may continue until the firearm magazine 94 is filled to capacity with the firearm rounds 44, after which the magazine receptacle 77 of the magazine mount assembly 76 may be removed from the magazine insert cavity 24 in the apparatus housing 2. The firearm magazine 94, which may be filled to capacity with the firearm rounds 44, may then be attached to a pistol or other small firearm (not illustrated) to facilitate firing of the rounds 44 from the firearm. An empty firearm magazine 94 may subsequently be attached to the magazine mount assembly 76, the firearm round feeder 64 refilled with the firearm rounds 44 and the apparatus 1 operated to load the firearm rounds 44 into the firearm magazine 94 typically in the same manner which was heretofore described.

Figure 26:
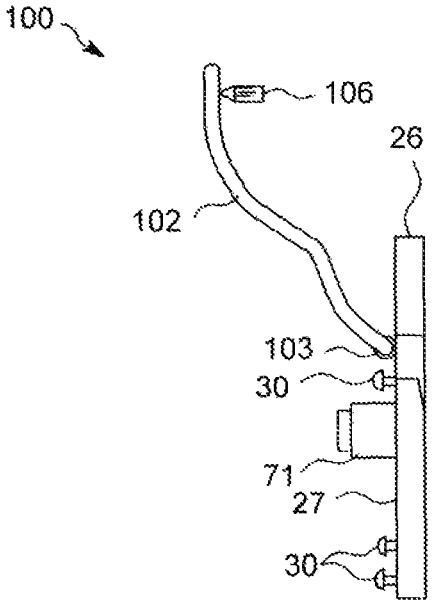

As the cogwheel 26 rotates in the forward direction in the cogwheel cavity 18 of the apparatus housing 2, the reverse inhibitor bolts 30 on the cogwheel hub 27 of the cogwheel 26 may sequentially engage the lever wheel 103 on the reverse inhibiting lever 102 of the reverse inhibiting mechanism 100, as illustrated in FIGS. 24-26. The lever wheel 103 permits passage of the reverse inhibitor bolts 30 in the forward rotational direction and engages and prevents passage of the reverse inhibitor bolts 30 in the reverse rotational direction of the cogwheel 26. Accordingly, the reverse inhibiting mechanism 102 may prevent reverse rotation and consequent jamming of the cogwheel 26 which may otherwise result.

In some embodiments, a counting device (not illustrated) may be provided on the apparatus housing 2 and placed into engagement with the cogwheel 26. The counting device may be suitably configured to count and indicate the firearm rounds 44 by number as they are loaded into the firearm magazine 94 according to the knowledge of those skilled in the art.

It will be appreciated by those skilled in the art that the apparatus 1 can be fabricated of various materials including but not limited to aluminum, steel, plastic, composite materials and/or other materials which are consistent with the functional requirements of the apparatus 1. The apparatus 1 can be fabricated using molding, casting and/or various other manufacturing and fabrication methods and techniques which are well-known to those skilled in the art. The firearm round feeder 64, the apparatus housing 2, the cogwheel 26, the magazine receptacle 77 of the magazine mount assembly 76 and other components of the apparatus 1 can be suitably sized and configured to expeditiously load firearm rounds 44 of various sizes and calibers, including but not limited to those of pistols and other small arms, as well as rifles and other large firearms, into a firearm magazine 94 of any suitable size and design.

Referring again to FIG. 17 of the drawings, it will be further appreciated by those skilled in the art that any desired number of the round cavities 35 may be provided in the cogwheel 26 such that each complete revolution of the cogwheel 26 and the crank 70 facilitates loading of a corresponding number of multiple firearm rounds 44 into the firearm magazine 94. In the non-limiting example which was heretofore described with respect to FIGS. 18-22, the cogwheel 26 has three round cavities 33 and is capable of correspondingly loading three firearm rounds 44 per revolution. This expedient facilitates expeditious loading of each firearm magazine 94, and may render the apparatus 1 particularly amenable to police and military applications. The cogwheel 26 facilitates continuous loading of the firearm rounds 44 into the firearm magazine 94 without jamming throughout rotation of the crank 70. This enables loading of as many firearm rounds 44 as may be required by magazines of any size or manufacturer, including but not limited to 8-50 round clips. The firearm round feeder 64 may be fabricated in various sizes to accommodate different-sized magazines 94. The apparatus 1 may automatically stop loading the firearm rounds 44 when the firearm magazine 94 is filled to capacity, and the reverse inhibiting mechanism 100 may prevent rotation of the cogwheel 26 in reverse to prevent jamming of the cogwheel 26, as was heretofore described.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A firearm magazine loading apparatus for loading firearm rounds into a firearm magazine, comprising:
- an apparatus housing;
- a cogwheel having a cogwheel rotational axis disposed for rotation in the apparatus housing, the cogwheel including:
  - a rounded cogwheel edge;
  - at least one round cavity in the cogwheel edge, the at least one round cavity sized and shaped to accommodate one of the firearm rounds and having:
    - an inner cavity surface;
    - a rear cavity surface extending from the inner cavity surface; and
    - an outer cavity surface extending from the rear cavity surface parallel to and facing the inner cavity surface, the outer cavity surface is proximate to the rounded cogwheel edge and the inner cavity surface is proximate to the cogwheel rotational axis;
- a firearm round feeder disposed in communication with the apparatus housing, the firearm round feeder configured to accommodate a plurality of firearm rounds;
- a magazine mount assembly disposed in communication with the apparatus housing, the magazine mount assembly configured to accommodate the firearm magazine; and
- a cogwheel driving mechanism drivingly engaging the cogwheel for rotation in the apparatus housing.

2. The firearm magazine loading apparatus of claim 1 further comprising a cogwheel cavity in the apparatus housing, and wherein the cogwheel is disposed for rotation in the cogwheel cavity.

3. The firearm magazine loading apparatus of claim 2 wherein the cogwheel cavity comprises a round inlet area, a round transport area and a round discharge area, and the firearm round feeder is disposed in communication with the round inlet area and the magazine mount assembly is disposed in communication with the round discharge area.

4. The firearm magazine loading apparatus of claim 1 further comprising a feeder housing carried by the apparatus housing and a round inlet cavity in the feeder housing, and wherein the cogwheel cavity is disposed in communication with the round inlet cavity and the firearm round feeder is disposed in communication with the round inlet cavity.

5. The firearm magazine loading apparatus of claim 4 further comprising a sloped round orienting surface in the round inlet cavity.

6. The firearm magazine loading apparatus of claim 4 further comprising a feeder receptacle cavity in the feeder housing, and wherein the firearm round feeder is seated in the feeder receptacle cavity.

7. The firearm magazine loading apparatus of claim 1 further comprising at least one cavity inlet bevel in the cogwheel edge adjacent and at an obtuse angle with respect to the inner cavity surface of the at least one round cavity.

8. The firearm magazine loading apparatus of claim 1 wherein the cogwheel driving mechanism comprises a crank.

9. The firearm magazine loading apparatus of claim 1 further comprising a reverse inhibiting mechanism carried by the apparatus housing and engaging the cogwheel, the reverse inhibiting mechanism configured to prevent reverse rotation of the cogwheel in the apparatus housing.

10. The firearm magazine loading apparatus of claim 9 wherein the reverse inhibiting mechanism comprises at least one reverse inhibitor bolt carried by the cogwheel, an elongated reverse inhibiting lever pivotally carried by the apparatus housing and disposed in a rotational path of the at least one reverse inhibiting bolt and a spring-loaded lever pin carried by the apparatus housing, the lever pin engaging and normally biasing the reverse inhibiting lever in a cogwheel-engaging position.

11. The firearm magazine loading apparatus of claim 10 further comprising a lever wheel carried by the reverse inhibiting lever.

12. The firearm magazine loading apparatus of claim 11 further comprising a lever slot in the apparatus housing, and wherein the reverse inhibiting lever extends through the lever slot.

13. A firearm magazine loading apparatus for loading firearm rounds into a firearm magazine, comprising:
- an apparatus housing;
- a cogwheel cavity in the apparatus housing, the cogwheel cavity including a round inlet area, a round transport area and a round discharge area;
- a cogwheel having a cogwheel rotational axis disposed for rotation in the cogwheel cavity in the apparatus housing, the cogwheel having a cogwheel rotational axis and including:
  - a rounded cogwheel edge;
  - a plurality round cavities in the cogwheel edge, the plurality of round cavities each sized and shaped to accommodate one of the firearm rounds and having:
    - a longitudinal cavity axis disposed perpendicular to the cogwheel rotational axis of the cogwheel;

an inner cavity surface;

a rear cavity surface extending from the inner cavity surface;

an outer cavity surface extending from the rear cavity surface parallel to and facing the inner cavity surface, the outer cavity surface is proximate to the rounded cogwheel edge and the inner cavity surface is proximate to the cogwheel rotational axis; and at least one cavity inlet bevel in the cogwheel edge adjacent and at an obtuse angle with respect to the inner cavity surface;

a feeder housing carried by the apparatus housing;

a round inlet cavity in the feeder housing, the round inlet area of the cogwheel cavity disposed in communication with the round inlet cavity;

a firearm round feeder disposed in communication with the round inlet cavity, the firearm round feeder configured to accommodate a plurality of firearm rounds;

a magazine mount assembly disposed in communication with the round discharge area of the cogwheel cavity, the magazine mount assembly configured to accommodate the firearm magazine; and a cogwheel driving mechanism drivingly engaging the cogwheel for rotation in the cogwheel cavity.

14. The firearm magazine loading apparatus of claim 13 further comprising a sloped round orienting surface in the round inlet cavity.

15. The firearm magazine loading apparatus of claim 14 further comprising a feeder receptacle cavity in the feeder housing, and wherein the firearm round feeder is seated in the feeder receptacle cavity.

16. The firearm magazine loading apparatus of claim 13 wherein the magazine mount assembly comprises a magazine receptacle sized and configured to accommodate the firearm magazine and a magazine retaining mechanism carried by the magazine receptacle, the magazine retaining mechanism configured to retain the firearm magazine in the magazine receptacle.

17. A firearm magazine loading apparatus for loading firearm rounds into a firearm magazine, comprising:

an apparatus housing;

a cogwheel cavity in the apparatus housing, the cogwheel cavity including a round inlet area, a round transport area and a round discharge area;

a cogwheel disposed for rotation in the cogwheel cavity in the apparatus housing, the cogwheel having a cogwheel rotational axis and including:

a rounded cogwheel edge;

a plurality round cavities in the cogwheel edge, the plurality of round cavities each sized and shaped to accommodate one of the firearm rounds and having:

a longitudinal cavity axis disposed perpendicular to the cogwheel rotational axis of the cogwheel;

an inner cavity surface;

a rear cavity surface extending from the inner cavity surface;

an outer cavity surface extending from the rear cavity surface parallel to and facing the inner cavity surface, the outer cavity surface is proximate to the rounded cogwheel edge and the inner cavity surface is proximate to the cogwheel rotational axis; and at least one cavity inlet bevel in the cogwheel edge adjacent and at an obtuse angle with respect to the inner cavity surface;

a feeder housing carried by the apparatus housing;

a feeder receptacle cavity in the feeder housing;

a round inlet cavity in the feeder housing adjacent to the feeder receptacle cavity, the round inlet area of the cogwheel cavity disposed in communication with the round inlet cavity;

a sloped round orienting surface in the round inlet cavity;

a firearm round feeder seated in the feeder receptacle cavity and disposed in communication with the round inlet cavity, the firearm round feeder configured to accommodate a plurality of firearm rounds;

a magazine mount assembly disposed in communication with the round discharge area of the cogwheel cavity, the magazine mount assembly configured to accommodate the firearm magazine; and a crank drivingly engaging the cogwheel for rotation in the cogwheel cavity.

18. The firearm magazine loading apparatus of claim 17 further comprising a reverse inhibiting mechanism carried by the apparatus housing and engaging the cogwheel, the reverse inhibiting mechanism configured to prevent reverse rotation of the cogwheel in the apparatus housing.

19. The firearm magazine loading apparatus of claim 18 wherein the reverse inhibiting mechanism comprises at least one reverse inhibitor bolt carried by the cogwheel, an elongated reverse inhibiting lever pivotally carried by the apparatus housing and disposed in a rotational path of the at least one reverse inhibiting bolt and a spring-loaded lever pin carried by the apparatus housing, the lever pin engaging and normally biasing the reverse inhibiting lever in a cogwheel-engaging position.

20. The firearm magazine loading apparatus of claim 19 further comprising a lever wheel carried by the reverse inhibiting lever, and further comprising a lever slot in the apparatus housing, and wherein the reverse inhibiting lever extends through the lever slot.

* * * * *